US006218453B1

(12) United States Patent
Boehm et al.

(10) Patent No.: US 6,218,453 B1
(45) **Date of Patent: *Apr. 17, 2001**

(54) GOLF BALL COMPOSITION

(75) Inventors: Herbert C. Boehm, Norwell, MA (US); Samuel A. Pasqua, Jr., Tiverton, RI (US)

(73) Assignee: Acushnet Company, Fairhaven, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/027,559

(22) Filed: Feb. 23, 1998

(51) Int. Cl.[7] ..... A63B 37/12; A63B 37/06

(52) U.S. Cl. ..... 524/433; 473/371; 473/372; 473/373; 473/377; 473/385

(58) Field of Search ..... 473/371, 372, 473/373, 377, 385; 524/433

(56) References Cited

U.S. PATENT DOCUMENTS

| | | | |
|---|---|---|---|
| 3,264,272 | 8/1966 | Rees | 260/78.5 |
| 3,454,280 | 7/1969 | Harrison et al. | 273/235 |
| 3,819,768 | 6/1974 | Molitor | 260/897 |
| 3,940,146 | 2/1976 | Little | 273/235 R |
| 4,274,637 | 6/1981 | Molitor | 273/235 R |
| 4,323,247 | 4/1982 | Keches et al. | 273/235 R |
| 4,508,309 | 4/1985 | Brown | 249/81 |
| 4,526,375 | 7/1985 | Nakade | 273/235 R |
| 4,679,795 | 7/1987 | Melvin et al. | 273/235 R |
| 4,715,607 | 12/1987 | Llort | 273/218 |
| 4,798,386 | 1/1989 | Berard | 273/235 R |
| 4,858,924 | 8/1989 | Saito et al. | 273/62 |
| 4,884,814 | 12/1989 | Sullivan | 273/235 R |
| 4,911,451 | 3/1990 | Sullivan et al. | 273/235 R |
| 4,986,545 | 1/1991 | Sullivan | 273/235 R |
| 5,000,459 | 3/1991 | Isaac | 273/235 R |
| 5,116,060 | 5/1992 | Sullivan et al. | 273/218 |
| 5,120,791 | 6/1992 | Sullivan | 525/196 |
| 5,328,959 * | 7/1994 | Sullivan . | |
| 5,387,637 | 2/1995 | Sullivan | 524/493 |
| 5,492,972 | 2/1996 | Stefani | 525/196 |
| 5,538,794 | 7/1996 | Cadorniga et al. | 428/407 |
| 5,588,924 * | 12/1996 | Sullivan . | |
| 5,695,413 * | 12/1997 | Yamagishi . | |
| 5,721,304 | 2/1998 | Pasqua, Jr. | 524/433 |
| 5,779,562 * | 7/1998 | Melvin . | |
| 5,803,832 * | 9/1998 | Nakamura . | |
| 5,886,103 * | 3/1999 | Bellinger . | |

FOREIGN PATENT DOCUMENTS

| | | |
|---|---|---|
| 779825 | 3/1968 | (CA) . |
| 0 490 619 | 6/1992 | (EP) . |
| 2 277 932 | 11/1994 | (GB) . |
| WO 95/00212 | 1/1995 | (WO) . |
| WO 97/30763 | 8/1997 | (WO) . |

* cited by examiner

*Primary Examiner*—David J. Buttner
(74) *Attorney, Agent, or Firm*—Pennie & Edmonds LLP

(57) ABSTRACT

A low compression golf ball comprising a core formed from a mixture, substantially free of zinc oxide, said mixture comprising polybutadiene, a metal salt of a material selected from the group consisting of diacrylates, dimethacrylates, and monomethacrylates, and calcium oxide, wherein the amount of the calcium oxide is sufficient to provide a core compression of less than 70, and a cover having a Shore D hardness of less than 65.

24 Claims, 1 Drawing Sheet

GOLF BALL COMPOSITION

FIELD OF THE INVENTION

This invention generally relates to golf balls, and, in particular, is directed to an improved low spin golf ball having a soft core and a soft cover.

BACKGROUND OF THE INVENTION

Today, golf balls are generally available as solid and wound balls. Solid golf balls, used by the typical amateur golfer, provide maximum durability and distance. These balls have a core formed of a solid sphere of one or more layers. Typically, these balls have hard cores for high initial velocity and hard covers for low spin and durability.

A number of polymers, such as polybutadiene, natural rubber, styrene butadiene, and isoprene, are used in fabricating the solid cores. Today, golf ball solid cores are predominantly made of polybutadiene. Moreover, in order to obtain the desired physical properties for golf balls, manufacturers have added cross-linking agents, such as metallic salts of an unsaturated carboxylic acid. The amount of cross-linking agent added is typically about 20 to 50 parts per hundred parts of polybutadiene. Most commonly, zinc diacrylate or zinc dimethacrylate are used for this purpose. Of these two cross-linkers, zinc diacrylate has been found to produce golf balls with greater initial velocity than zinc dimethacrylate.

Typically, about 5 to 50 pph (parts per hundred) of zinc oxide (ZnO) is also added to the composition. This material serves as both a filler and an activation agent for the zinc diacrylate/peroxide cure system. The zinc diacrylate/peroxide cure system, which is well known to those of ordinary skill in this art, cross-links the polybutadiene during the core molding process. The high specific gravity of zinc oxide (5.57) can serve the dual purposes of adjusting the weight of the golf ball, in addition to acting as an activation agent.

As zinc oxide is known to be an environmentally unfriendly material, it would be advantageous to eliminate or at least substantially reduce the amount of this material from the manufacturing process. However, when the zinc oxide is eliminated from the composition described above, there is a reduction in cure enhancement, which results in less cross-linking and a corresponding reduction in compression and velocity. This result provides a ball with a softer feel, but the resulting ball has substantially less than the maximum velocity allowed by the USGA standard.

Therefore, it would be advantageous to provide a golf ball core composition with an activation agent other than zinc oxide, i.e., wherein all or at least some of the zinc oxide commonly present was eliminated, which would provide a ball with the lower compression, as noted above, but would maintain the velocity and distance of a high compression ball.

Wound balls, which are generally preferred by better players have higher spin characteristics and softer feel. Wound balls include either a solid rubber or a liquid filled center that is covered by many meters of elastic windings. Such cores are thereafter encased in a cover formed of SURLYN®, polyurethane, or balata rubber. The winding and softer covers provide three-piece balls with higher spin rates and more control for better golfers.

Regardless of the form of the ball, players generally seek a golf ball that delivers maximum distance, which requires a high initial velocity upon impact. Therefore, in an effort to meet the demands of the marketplace, manufacturers generally strive to produce golf balls with initial velocities that approximate the USGA maximum of 77.7 m/s or 255 ft/s as closely as possible.

Golf ball manufacturers are also concerned with varying the level of the compression of the ball, which is a measurement of the deformation of a golf ball or core in inches under a fixed load. Higher velocity on impact, and, hence, greater distance, is generally achieved by increasing the golf ball compression. Higher golf ball compression also generates a harder "feel". Moreover, harder balls must also have a hard cover to keep the driver spin rate down.

As stated above, better players generally prefer the wound golf balls that have soft covers. The soft cover provides increase spin and feel around the greens. However, these players are traditionally giving up distance off the tee because they generate too much spin.

Golf ball manufacturers are continually searching for new ways in which to provide golf balls that deliver the maximum performance for golfers of all skill levels. They seek to discover compositions that provide the distance performance of hard balls and the feel of approach shot spin of softer balls.

SUMMARY OF THE INVENTION

The present invention is directed to an improved low spin ball for good distance characteristics and soft cover for softer feel. More particularly, the present invention is directed to a golf ball having a large, soft core with a low compression and the zinc oxide in the core pomposition is replaced with calcium oxide. Further, the present invention has a thin, soft cover to provide a soft feel and maintain velocity.

The invention is also directed to the composition for the manufacture of improved low spin golf balls, and, in particular, golf ball cores and covers. The improved golf ball core composition comprises polybutadiene, a metal salt diacrylate or dimethacrylate, preferably, zinc diacrylate in an amount of about 20 to 50 parts per hundred parts of polybutadiene, and a free radical initiator, to which calcium oxide (CaO) is added instead of zinc oxide as an activation agent in an amount sufficient to produce a golf ball core with the advantageous properties discussed below. Moreover, the core is a large core so that initial velocity is maintained when using a soft cover.

It has been found that when zinc oxide is eliminated from a golf ball core composition as an activating agent in favor of calcium oxide, a lower compression golf ball core is obtained. Such cores, when incorporated into a finished golf ball, provide a high initial velocity in the USGA test that is comparable in velocity to a standard, high compression ball that incorporates a core using zinc oxide, but have lower spin rates. Preferably, the calcium oxide is added in an amount that reduces the compression and driver spin rate of the golf ball, while maintaining the initial velocity of the ball in the USGA tests.

Moreover, the invention includes a soft cover of less than about 65 Shore D. Preferably, the cover is thinner to compensate for the large core and is comprised of a composition that is a combination of at least two ionomer resins having different flexural moduli. Preferably, the ionomers are copolymers or terpolymers with an olefin and an alpha, beta-unsaturated carboxylic acid that is partially neutralized with a metal salt.

The combination of the soft cover with the large, lower compression golf ball core provides a ball with a high initial velocity and low driver spin rate for distance as well as a soft feel and high approach shot spin rate for control and feel around the greens.

DETAILED DESCRIPTION OF THE PREFERRED EMBODIMENTS

As used herein, the terms "core" and "golf ball core" are generic, and include cores for solid golf balls, and dual layer cores for solid golf balls. The core composition of the present invention can be used to form a unitary golf ball, a core for a solid golf ball, or a center for a three-piece or wound golf ball, as desired. However, as set forth below, the invention is primarily directed to the use of the composition to form a core for a solid, non-wound ball with a soft cover preferably formed from a blend of materials such as SURLYN® ionomer resins.

For purposes of the present invention, the term "reaction conditions" can refer to any reaction condition that can affect the ability of the inventive core compositions to form free radicals. Reaction conditions include, for example, temperature, time and pressure.

As used herein, the terms "compression" or "compression points" refer to the compression scale based on the ATTI Engineering Compression Tester and is sometimes referred to as the "PGA compression" scale. This scale, which is well known to those working in this field, ranges from 1 to 160 points and is used in determining the relative compression of a core or ball. Some skilled artisans who do not use the PGA compression scale instead use Reihle compression values.

Based on disclosure in U.S. Pat. No. 5,368,304, the Reihle compression values may be converted to standard compression values through the use of the following equation:

$$\text{compression points} = 160 - \text{Reihle compression value}.$$

Figure 1:
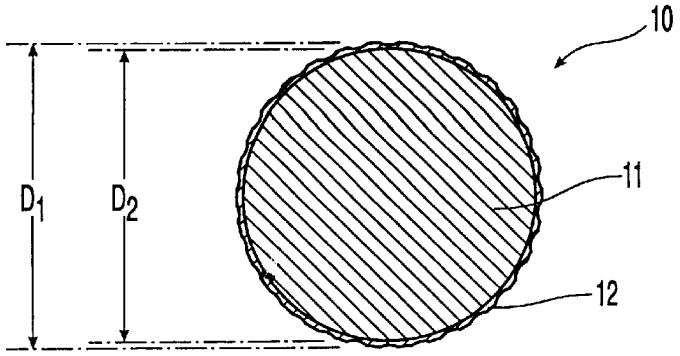
FIG. 1 is a cross-section of a golf ball according to the present invention.

Referring to FIG. 1, the present invention is directed to an improved low spin golf ball 10 comprising a core 11 and a cover 12. The ball 10 has a first diameter DI that is 1.68 inches or greater and the core 11 has a second diameter D2 that is 1.55 inches or greater.

Figure 2:
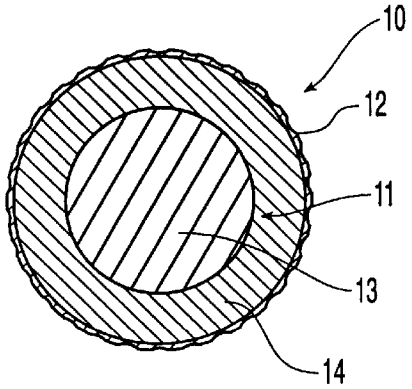
FIG. 2 is a cross-section of a second embodiment of a golf ball according to the present invention.

As set forth in FIG. 2, the present invention can also include a golf ball 10 comprising a core 11 and a cover 12 wherein the core 11 is comprised of more than one layer, i.e., a center 13 and an outer layer 14. Preferably, both the center 13 and the outer layer 14 are solid, non-wound layers comprised of polybutadiene rubber compositions with the outer layer 14 being softer than the center 13 as discussed in more detail below.

Figure 3:
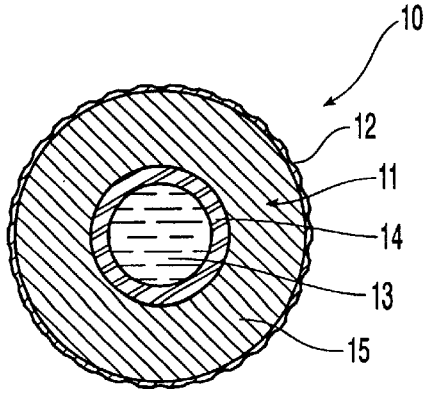
FIG. 3 is a cross-section of a third embodiment of a golf ball according to the present invention.

Finally, referring to FIG. 3, another embodiment of the present invention is directed to a golf ball 10 comprised of a core 11 and a cover 12, wherein the core 11 is comprised of a fluid center 13, a first solid, non-wound layer surrounding the fluid center 14 and a second solid, non-wound layer 15. In each of these embodiments, the golf ball includes a soft, low compression, non-wound core 11 and a soft cover 12 having one or more layers, as set forth in more detail below. A representative base composition for forming a soft golf ball core 11, prepared in accordance with the present invention, comprises polybutadiene and, in parts by weight based on 100 parts polybutadiene, 20–50 parts of a metal salt diacrylate, dimethacrylate, or monomethacrylate, preferably zinc diacrylate. The polybutadiene preferably has a cis 1,4 content of above about 90% and more preferably above about 96%. Commercial sources of polybutadiene include Shell 1220 manufactured by Shell Chemical, Neocis BR40 manufactured by Enichem Elastomers, and Ubepol BR150 manufactured by Ube Industries, Ltd. If desired, the polybutadiene can also be mixed with other elastomers known in the art, such as natural rubber, styrene butadiene, and/or isoprene in order to further modify the properties of the core. When a mixture of elastomers is used, the amounts of other constituents in the core composition are generally based on 100 parts by weight of the total elastomer mixture.

Metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it provides golf balls with a high initial velocity in the USGA test. The zinc diacrylate can be of various grades of purity. For the purposes of this invention, the lower the quantity of zinc stearate present in the zinc diacrylate the higher the zinc diacrylate purity. Zinc diacrylate containing about 1–10% zinc stearate is preferable. More preferable is zinc diacrylate containing about 4–8% zinc stearate. Suitable, commercially available zinc diacrylates include those from Rockland React-Rite and Sartomer. The preferred concentrations of zinc diacrylate that can be used are 20–50 pph based upon 100 parts of polybutadiene or alternately, polybutadiene with a mixture of other elastomers.

Free radical initiators are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di (t-butylperoxy) 3,3,5-trimethyl cyclohexane, a-a bis (t-butylperoxy) diisopropylbenzene, 2,5-dimethyl-2,5 di (t-butylperoxy) hexane, or di-t-butyl peroxide, and mixtures thereof. Other useful initiators would be readily apparent to one of ordinary skill in the art without any need for experimentation. The initiator(s) at 100% activity are preferably added in an amount ranging between about 0.05 and 2.5 pph based upon 100 parts of butadiene, or butadiene mixed with one or more other elastomers. More preferably, the amount of initiator added ranges between about 0.15 and 2 pph and most preferably between about 0.25 and 1.5 pph.

A typical prior art golf ball core incorporates 5 to 50 pph of zinc oxide in a zinc diacrylate-peroxide cure system that cross-links polybutadiene during the core molding process. The high specific gravity of zinc oxide, about 5.57, permits the adjustment of the specific gravity of the core and resulting golf ball incorporating the core. As noted above the elimination, or at least the reduction of environmentally unfriendly zinc oxide from the manufacturing process is desirable. However, in the case of golf ball core formulations, completely eliminating zinc oxide results in a significant reduction in cure enhancement, so that there is a reduction in the cross-linking of the polybutadiene with a resultant decrease in both compression and initial velocity in the USGA test. Although the core and resulting ball has a softer feel, driving distance suffers as a result of the significantly lower initial velocity.

When zinc oxide (ZnO) is eliminated in favor of calcium oxide (CaO) in a golf ball core composition of polybutadiene and a metal salt diacrylate, dimethacrylate, or monomethacrylate, the cores and balls produced from such an admixture typically exhibit enhanced performance properties. The initial velocity of the standard ball is maintained at or near the maximum allowed by the USGA, but the compression of the ball is reduced by at least about 2 compression points on the PGA scale, and may be reduced as much as 14 points. Where the amount of zinc oxide incorporated in prior art cores is, as noted above, typically about 5 to 50 pph, the amount of calcium oxide added to the core-forming composition of the invention as an activator is typically in the range of about 0.1 to 15, preferably 1 to 10, most preferably 1.25 to 5, parts calcium oxide per hundred parts (pph) of polybutadiene.

The compositions of the present invention may also include fillers, added to the elastomeric composition to adjust the density and/or specific gravity of the core. As used herein, the term "fillers" includes any compound or composition that can be used to vary the density and other properties of the subject golf ball core. Fillers useful in the golf ball core according to the present invention include, for example, zinc oxide (in an amount significantly less than that which would be necessary without the addition of the calcium oxide), barium sulfate, and regrind (which is recycled core molding matrix ground to 30 mesh particle size). The amount and type of filler utilized is governed by the amount and weight of other ingredients in the composition, since a maximum golf ball weight of 1.620 ounces (45.92 gm) has been established by the USGA. Appropriate fillers generally used range in specific gravity from about 2.0 to 5.6.

Golf ball cores made according to the present invention can be of any specific gravity which can be used in a golf ball. The preferred range of specific gravities of the present invention is from about 0.9 to about 1.5 or more, more preferably in the range of about 1 to about 1.25, depending upon the size of the core, cover, and finished ball, as well as the specific gravity of the cover. For example, the core specific gravity will be lower if the cover includes a filler to increase the specific gravity of the cover.

Antioxidants may also be included in the elastomer cores produced according to the present invention. Antioxidants are compounds which prevent the breakdown of the elastomer. Antioxidants useful in the present invention include, but are not limited to, quinoline type antioxidants, amine type antioxidants, and phenolic type antioxidants.

Other ingredients such as accelerators, e.g. tetra methylthiuram, processing aids, processing oils, plasticizers, dyes and pigments, as well as other additives well known to the skilled artisan may also be used in the present invention in amounts sufficient to achieve the purpose for which they are typically used.

The compositions of the invention are typically produced by forming a mixture comprising at least polybutadiene, zinc diacrylate, and an amount of calcium oxide sufficient to reduce the compression by at least about 2 points on the PGA compression scale, compared to a core composition substituting zinc oxide for the calcium oxide, optionally with one or more additional components, such as additives.

When a set of predetermined conditions is met, i.e., time and temperature of mixing, the free radical initiator is added in an amount dependent upon the amounts and relative ratios of the starting components, as would be well understood by one of ordinary skill in the art. In particular, as the components are mixed, the resultant shear causes the temperature of the mixture to rise. Peroxide(s) free radical initiator(s) are blended into the mixture for crosslinking purposes in the molding process.

After completion of the mixing, the golf ball core composition is milled and hand prepped or extruded into pieces ("preps") suitable for molding. The preps are then compression molded into cores at an elevated temperature. Typically, 160° C. (320° F.) for 15 minutes is suitable for this purpose. These cores can then be used to make finished golf balls by surrounding the cores with standard cover materials.

CORE EXAMPLES

These and other aspects of the present invention may be more fully understood with reference to the following non-limiting examples, which are merely illustrative of the preferred embodiments of the present invention, and are not to be construed as limiting the invention, the scope of which is defined by the appended claims.

Examples 1–3

The results obtained with golf ball cores and balls prepared according to the following examples are representative of the improved performance characteristics of golf ball cores and golf balls made from the core compositions of this invention. The core compositions used to prepare the golf balls of these examples contained the ingredients listed in Table I below in the specified amounts, which are all in parts per hundred (pph), based on 100 parts of polybutadiene. The fillers used in the compositions of these examples are regrind and barium sulfate ($BaSO_4$). Either calcium oxide or zinc oxide is used as an activation agent. Vulcup 40KE® and Varox 231XL® are free radical initiators, and are a—a bis (T-butylperoxy) diisopropylbenzene and 1,1-di (T-butylperoxy) 3,3,5-trimethyl cyclohexane, respectively. Yel MB is a yellow pigment in a styrene butadiene binder, which is used to color the composition for identification purposes. The zinc diacrylate contained no more than about 4–8% zinc stearate.

All the ingredients except the peroxides were mixed in a Process Lab Brabender mixer to 82.2–93.3° C. (180–200° F.). The peroxides were added in the second stage to the initial mixture, and the resulting mixture was removed from the Brabender and blended on a lab mill to insure homogeneity. After mixing, the admixture was then hand rolled using a laboratory mill and cut into pieces or "preps". These preps were then compression molded at 160° C. (320° F.) for 15 minutes to form the cores. To fabricate the finished golf balls, the cores were inserted into two cover hemispheres of a lithium-sodium blend of SURLYN®, which were molded to encase the core.

The cores and balls prepared according to the above-described method were tested for their compression and initial velocity. The compression ratings were obtained using an ATTI compression tester. The initial velocity results were obtained from a standard technique, whereby the cores or balls are struck at 39.6 m/s (130 ft/s), and pass through light gates, which measure their speed. Both of these standard measurement techniques are well-known to those of ordinary skill in the art of making golf ball cores and balls.

TABLE I

| | Control | 1 | 2 | 3 |
|---|---|---|---|---|
| Polybutadiene | 100.0 | 100.0 | 100.0 | 100.0 |
| Regrind | 16.3 | 16.3 | 16.3 | 16.3 |
| Vulcup 40KE ® | 0.23 | 0.23 | 0.23 | 0.23 |
| Varox 231XL ® | 0.43 | 0.43 | 0.43 | 0.43 |
| $BaSO_4$ | 20.5 | 20.5 | 20.5 | 20.5 |

TABLE I-continued

| | Control | 1 | 2 | 3 |
|---|---|---|---|---|
| Yel MB | 0.10 | 0.10 | 0.10 | 0.10 |
| Zinc diacrylate | 26.9 | 26.9 | 26.9 | 26.9 |
| Zinc Oxide | 5.0 | 2.5 | — | — |
| Calcium Oxide | — | — | — | 5.0 |

TABLE II

| | Control | 1 | 2 | 3 |
|---|---|---|---|---|
| Zinc Oxide (pph) | 5.0 | 2.5 | — | — |
| Calcium Oxide (pph) | — | — | — | 5.0 |
| Core Initial Velocity | 250.79 | 250.83 | 250.19 | 250.33 |
| Ball Initial Velocity | 253.47 | 253.42 | 253.01 | 253.44 |
| Core Compression | 80.4 | 77.1 | 68.4 | 71.3 |
| Ball Compression | 97.8 | 96.2 | 85.8 | 90.3 |

As shown in Table II, a 50 percent reduction in the zinc oxide concentration in Example 1 results in a decrease in ball compression of only 1.6 points and a slight drop in initial velocity. Similar results are obtained with the core. The complete removal of zinc oxide in Example 2 reduces the compression of both the core and the ball by 12 points, but also reduces the initial velocity of the core and ball significantly. When the zinc oxide is eliminated from the core composition, and calcium oxide is added in Example 3, both the cores and finished balls containing calcium oxide have a lower compression, but the initial velocity of the low compression balls and cores is comparable to that of the high compression control.

Examples 4–8

The cores and finished balls of these examples were prepared according to the method used in Examples 1–3. However, the zinc oxide concentration was varied over a wider range. Table III provides a description of the contents of the balls used in each of these examples. Again the quantities are in terms of parts per 100 parts of polybutadiene.

TABLE III

| | Control | 4 | 5 | 6 | 7 | 8 |
|---|---|---|---|---|---|---|
| Polybutadiene | 100.0 | 100.0 | 100.0 | 100.0 | 100.0 | 100.0 |
| Regrind | 16.3 | 16.3 | 16.3 | 16.3 | 16.3 | 16.3 |
| Vulcup 40KE ® | 0.23 | 0.23 | 0.23 | 0.23 | 0.23 | 0.23 |
| Varox 231XL ® | 0.43 | 0.43 | 0.43 | 0.43 | 0.43 | 0.43 |
| $BaSO_4$ | 20.5 | 20.5 | 20.5 | 20.5 | 20.5 | 20.5 |
| Yel. MB | 0.10 | 0.10 | 0.10 | 0.10 | 0.10 | 0.10 |
| Zinc Diacrylate | 26.9 | 26.9 | 26.9 | 26.9 | 26.9 | 26.9 |
| Zinc Oxide | 5.0 | 3.75 | 2.5 | 1.25 | — | — |
| Calcium Oxide | — | — | — | — | — | 5.0 |

TABLE IV

| | Control | 4 | 5 | 6 | 7 | 8 |
|---|---|---|---|---|---|---|
| Zinc Oxide (pph) | 5.0 | 3.75 | 2.5 | 1.25 | — | — |
| Calcium Oxide (pph) | — | — | — | — | — | 5.0 |
| Core Initial Velocity | 250.36 | 251.00 | 250.79 | 250.80 | 249.95 | 250.14 |
| Ball Initial Velocity | 252.50 | 252.89 | 252.83 | 252.78 | 252.14 | 252.67 |
| Core PGA Compression | 76.5 | 76.4 | 73.8 | 73.8 | 65.9 | 67.4 |
| Ball PGA Compression | 93.8 | 96.0 | 94.2 | 93.7 | 87.6 | 87.5 |

Table IV illustrates the compression ratings and initial velocity results for Examples 4–8. These results were obtained by the same measurement techniques described above. The results further show that small decreases in the zinc oxide concentration have little or no effect on the compression and initial velocities of either the cores or the complete golf balls. However, the complete removal of zinc oxide results in significant reductions in compression, i.e., 10.6 points for the cores and 6.2 points for the complete golf balls, and a significant reduction in the initial velocities of both the cores and the completed golf balls. The present invention, as discussed above, comprises embodiments wherein the zinc oxide is totally excluded, as well as those in which the zinc oxide is present, but in significantly reduced amounts due to the addition of the calcium oxide. Example 8 shows that the replacement of the zinc oxide filler with calcium oxide provides a reduction in core compression of 9.1 points and a reduction in ball compression of 8.5 points, while the initial velocity of both the core and the complete ball in the USGA test are again comparable.

Examples 9–10

The cores and finished balls of these examples were prepared according to the method used in Examples 1–8. However some variations were made to the amounts of ingredients used as shown in Table V. Again the quantities are in terms of parts per 100 parts of polybutadiene.

TABLE V

| | Control | 9 | 10 |
|---|---|---|---|
| Polybutadiene | 100.0 | 100.0 | 100.0 |
| Regrind | 16.3 | 16.3 | 16.3 |
| Vulcup 40KE ® | 0.23 | 0.23 | 0.23 |
| Varox 231XL ® | 0.43 | 0.43 | 0.43 |
| $BaSO_4$ | 20.5 | 20.5 | 20.5 |
| Yel.MB | 0.10 | 0.10 | 0.10 |
| Zinc Diacrylate | 26.9 | 26.9 | 26.9 |
| Zinc Oxide | 5.0 | 1.25 | — |
| Calcium Oxide | — | — | 5.0 |

TABLE VI

| | Control | 9 | 10 |
|---|---|---|---|
| Zinc Oxide (pph) | 5.0 | 1.25 | — |
| Calcium Oxide (pph) | — | — | 5.0 |
| Core Initial Velocity | 250.94 | 250.98 | 250.66 |
| Ball Initial Velocity | 253.18 | 253.04 | 252.97 |
| Core Compression | 79.4 | 75.2 | 73.1 |
| Ball Compression | 97.7 | 96.6 | 92.5 |

Table VI illustrates the compression ratings and initial velocity results for Examples 9–10. These results were obtained by the same measurement techniques described above. The results further show that the compositions of this invention generally provide cores and finished balls with decreased compression rating, yet with an initial velocity comparable to higher compression balls.

Examples 11–19

These examples show the effects of varying the concentration of both zinc oxide and calcium oxide. The concentrations of the ingredients used in the various compositions are shown in Table VII. Again the quantities of the ingredients are in terms of parts per 100 parts of polybutadiene.

TABLE VII

| | Control | 11 | 12 | 13 | 14 | 15 | 16 | 17 | 18 | 19 |
|---|---|---|---|---|---|---|---|---|---|---|
| Polybutadiene | 100 | 100 | 100 | 100 | 100 | 100 | 100 | 100 | 100 | 100 |
| Regrind | 16.3 | 16.3 | 16.3 | 16.3 | 16.3 | 16.3 | 16.3 | 16.3 | 16.3 | 16.3 |
| Vulcup 40KE ® | 0.23 | 0.23 | 0.23 | 0.23 | 0.23 | 0.23 | 0.23 | 0.23 | 0.23 | 0.23 |
| Varox 231XL ® | 0.43 | 0.43 | 0.43 | 0.43 | 0.43 | 0.43 | 0.43 | 0.43 | 0.43 | 0.43 |
| $BaSO_4$ | 20.5 | 22.0 | 23.1 | 24.2 | 25.8 | 21.5 | 22.5 | 23.5 | 24.7 | 12.0 |
| Yel. MB | 0.10 | 0.10 | 0.10 | 0.10 | 0.10 | 0.10 | 0.10 | 0.10 | 0.10 | 0.10 |
| Zinc Diacrylate | 26.9 | 26.9 | 26.9 | 26.9 | 26.9 | 26.9 | 26.9 | 26.9 | 26.9 | 26.9 |
| Zinc Oxide | 5.0 | 3.75 | 2.50 | 1.25 | — | — | — | — | — | — |
| Calcium Oxide | — | — | — | — | — | 5.0 | 3.75 | 2.50 | 1.25 | 15.0 |

TABLE VIII

| | Control | 11 | 12 | 13 | 14 | 15 | 16 | 17 | 18 | 19 |
|---|---|---|---|---|---|---|---|---|---|---|
| Zinc Oxide (pph) | 5.0 | 3.75 | 2.50 | 1.25 | — | — | — | — | — | — |
| Calcium Oxide (pph) | — | — | — | — | — | 5.0 | 3.75 | 2.50 | 1.25 | 15.0 |
| Core Initial Velocity | 250.63 | 250.74 | 250.55 | 250.52 | 249.38 | 250.56 | 250.30 | 250.21 | 250.24 | 248.56 |
| Ball Initial Velocity | 252.62 | 252.83 | 252.62 | 252.43 | 251.71 | 252.91 | 252.80 | 252.81 | 252.55 | 250.92 |
| Core PGA Compression | 81.2 | 81.8 | 78.8 | 78.4 | 70.1 | 69.7 | 68.8 | 69.2 | 70.5 | 44.1 |
| Ball PGA Compression | 97.0 | 100.3 | 98.3 | 96.8 | 89.6 | 88.2 | 87.6 | 86.4 | 88.4 | 62.8 |

Table VIII illustrates the compression ratings and initial velocity results for Examples 11–19. These results were obtained by the same measurement techniques described above. The results show that the advantages of the present invention are available with amounts of calcium oxide as low as 1.25 pph.

Referring to the core 11 shown in FIG. 2, the center is preferably harder than the outer layer. More particularly, the core has a compression ratio of at least 10, and preferably 20, more than the outer layer. The compression ratio being determined by a core made entirely of the material of each layer, i.e., the compression ratio for the center is determined by forming a 1.58 inch core of the first layer material and testing its compression on an ATTI Engineering Compression Tester. The center preferably has a compression ratio of greater than 80 compression points and the outer layer has a compression ratio of less than 60 compression points. Thus, the overall ball compression can be maintained to a compression of less than 80 compression points.

The center of the ball shown in FIG. 2 has a diameter of about 0.75 to 1.25 inches and preferably is comprised of a polybutadiene rubber with zinc oxide as the cross linking agent and the outer layer is a polybutadiene with calcium oxide as the cross linking agent as set forth above. In the most preferred embodiment, the center has a diameter of about 0.95 inches and is comprised of the formulation set forth in comparative Example 11 above and the outer layer is formed from the formulation set forth in Example 15 above.

Referring now to the cover of the present invention, it is thinner to accommodate for the large core and maintain initial velocity. The cover is preferably 0.04 to 0.065 inches thick. It is preferably made of a soft feel material such as natural or synthetic balata, polyurethane or a soft surlyn blend. More preferably the cover is comprised of a blend of two materials, a very soft material and a harder material. Preferably, the cover is comprised of about 5 to about 60 parts by weight based on 100 parts by weight resin (phr) of a low flexural modulus ionomer resin; and about 95 to about 40 phr of a conventional ionomer resin. A low flexural modulus ionomer is one that has a flexural modulus of less than 20,000 psi. Conventional ionomer resins are those that have a flexural modulus between 50,000 and 70,000 psi. Examples of suitable low flexural modulus ionomers and conventional ionomers are provided below.

Preferably, the amount of low flexural modulus ionomer resin used in the present invention is about 20 to about 50 phr and the amount of conventional ionomer resin used in the present invention is about 80 to about 50 phr.

Preferably, the low flexural modulus ionomer resin is a terpolymer comprising about 95 to about 50 parts by weight of an olefin such as ethylene, about 5 to about 13 parts by weight of an alpha, beta-unsaturated carboxylic acid such as acrylic or methacrylic acid and 0 to 50 parts by weight of an n- or iso-alkyl acrylate or methacrylate, in which about 10% to about 90% of the carboxylic acid groups are neutralized by a metal ion such as sodium, lithium, zinc, magnesium or the like.

Preferably, the conventional ionomer resin is a copolymer comprising about 95 to about 80 parts by weight of an olefin such as ethylene and about 5 to about 20 parts by weight of an alpha, beta-unsaturated carboxylic acid such as acrylic or methacrylic acid in which about 10 to 90% of the carboxylic acid groups are neutralized by a metal ion. Preferably, the conventional ionomer resin has about 10% to about 90% of the acid groups neutralized by lithium, sodium, zinc, magnesium or the like.

Preferably, the low flexural modulus ionomer resin used in the present invention has a flexural modulus between about 1,000 and about 20,000 psi (5 and 140 MPa) and, more preferably, between about 2,000 and about 10,000 psi (10 to 70 MPa).[1]

[1] The flexural modulus is measured in accordance with A.S.T.M. Method D-790.

Preferably, the conventional ionomer resin has a higher flexural modulus which is between about 60,000 psi (415 MPa) and 70,000 psi (485 MPa). Good results have been obtained with the lithium ionomer resins having flexural moduli in the range of about 60,000 psi to about 70,000 psi (415 to 485 MPa), since these ionomers tend to exhibit a high initial velocity.

Preferably, the ionomer resins have the same monocarboxylic acid, e.g. either methacrylic or acrylic acid.

To aid in the processing of ionomer cover stock, it is conventional to use a plurality of ionomer resins to obtain the desired characteristics. Conventionally, ionomer resins with different melt flow indexes are employed to obtain the desired characteristics of the cover stock. In order to adjust the characteristics of the cover stock, other ionomer resins can be employed.

Low modulus, sodium ionomer resins sold by DuPont under the name SURLYN 8320, SURLYN 8269 and SURLYN 8265 work well in the present invention. Good results have been obtained with a conventional ionomer resin sold under the trade name SURLYN 8118, 7930, 7940 and 8660 by DuPont.

SURLYN 8320, SURLYN 8269 and SURLYN 8265 have flexural modulus of 2,800 psi (20 MPa), 2,800 psi (20 MPa) and 7,100 psi (50 MPa), respectively.[2] SURLYN 8118, 7930 and 7940 have flexural modulus of 61,000 psi (420 MPa), 67,000 psi (460 MPa) and 61,000 psi (420 MPa) respectively.

[2] Flexural modulus as published by DuPont.

SURLYN 8118, 7930 and 7940 have melt flow indexes of about 1.4, 1.8 and 2.6 g/10 min., respectively. SURLYN 8269 and SURLYN 8265 both have a melt flow index of about 0.9 g/10 min.[3] Preferably, the blend of ionomer resins used to make a cover of a golf ball in accordance with the present invention has a melt flow index between about 1 to about 4 g/10 min. and, more preferably, about 1 to about 3 g/10 min.

[3] Melt flow index is measured in accordance with A.S.T.M. Test D 1238, condition E, procedure A.

The combined amount of conventional ionomer resin and low modulus ionomer resin used to make a cover in accordance with the present invention as herein described generally makes up at least about 90% by weight of the total weight of the golf ball cover and, preferably, at least about 95% by weight. Additional materials which may be included in the golf ball cover are other SURLYN resins; whitening agents such as titanium dioxide; dyes; UV absorbers; optical brighteners; and other additives which are conventionally included in golf ball covers.

Golf ball covers made from ionomer resins in accordance with the present invention are made in a conventional manner by molding cover stock about a core. Molding is accomplished either by injection molding cover stock about a core or by compression molding preformed half-shells about a core.

The preferred method of forming ionomer resin covers over a core is compression molding. Half-shells are made by injection molding a cover stock into a conventional half-shell mold in a conventional manner. The preformed half-shells are then placed about a core and the assembly is introduced into a compression molding machine. The compression molding machine is a hydraulic press having an upper and lower mold plate. As taught by U.S. Pat. No. 4,508,309 issued Apr. 2, 1985, such mold plate has half molds, each of which is registered with another half mold in the opposite mold plate. It has been found that a golf ball is formed with a cover in accordance with the present invention when the half-shells are compression molded about a core at about 300° F. (149° C.) for about 3 minutes. The molded balls are then cooled while still in the mold and finally removed when the cover is hard enough to be handled without deforming.

After the balls have been molded, they undergo various conventional finishing operations such as buffing, painting and stamping.

Preferably, the cover stock used to make a golf ball cover in accordance with the present invention is a blend of the ionomer resins as specified hereinabove. Blending of the ionomer resins is accomplished in a conventional manner using conventional equipment. Good results have been obtained by mixing the ionomer resins in a solid, pelletized form and then placing the mix into a hopper which is used to feed the heated barrel of the half-shell or cover injection molding machine. Further mixing is accomplished by a screw in the heated barrel. Such machines are conventional.

GOLF BALL EXAMPLES

These and other aspects of the present invention may be more fully understood with reference to the following non-limiting examples, which are merely illustrative of a preferred embodiment of the present invention golf ball, and is not to be construed as limiting the invention, the scope of which is defined by the appended claims.

The results obtained with a golf ball core and ball prepared according to the examples are provided to show the improved performance characteristics of golf ball core and cover made from the compositions of this invention. Example 20 represents a 1.68 inch diameter golf ball having a soft core made with zinc oxide present in an amount of less than 5 pph of polybutadiene and having a 1.58 inch diameter. Example 21 represents a 1.68 inch diameter golf ball having a soft core made with calcium oxide present in an amount of less than 5 pph of polybutadiene and having a diameter of 1.58 inches. Both of the Examples 20 and 21 have a cover consisting essentially of about 30% of a low modulus ionomer (SURLYN 8320 is a sodium ionomer resin) and 70% of conventional ionomer (7940 is a lithium ionomer and 8660 is a sodium ionomer). The preferred low modulus ionomer is a sodium ionomer, but others such a low modulus zinc ionomers could be used. The preferred conventional ionomer is a lithium ionomer or blend of lithium ionomer with sodium or zinc ionomer. The test results show the significant low spin rate performance characteristics of Examples 20 and 21 over prior art balls. The test results do not show the improved feel that is achieved with the balls in Example 20 and 21. For example, because the compression of the cores is less than 60 and the balls is less than 70, the balls in Example 20 and 21 have a good feel when hit with a driver. Further, because the covers have a Shore D hardness of less than 62, they have a good feel when putting.

Table IX sets forth the contents of the golf ball core that were made to illustrate the effect of using a softer, larger core with a soft cover according to the present invention. The core in Example 20 contains only 4.7 pph zinc oxide and the core in Example 21 contained 4.7 pph of calcium oxide. The composition used to prepare the golf ball cores of these examples are in parts per hundred (pph), based on 100 parts of polybutadiene, which was a mixture of Shell and Enichem rubbers. The fillers used in the compositions of these examples are regrind and polywate. DBDB-60 and Varox 231XL® are free radical initiators, and are a-a bis (t-butylperoxy) diisopropylbenzene and 1,1-di (t-butylperoxy) 3,3,5-trimethyl cyclohexane, respectively. The zinc diacrylate contained no more than about 4–8% zinc stearate.

The cores were prepared in the conventional manner set forth above and covered withthe blend of SURLYN® as set forth in Table X.

The cores and balls prepared according to the above-described method were tested for compression and initial velocity as set forth above. Both of these standard measurement techniques are well-known to those of ordinary skill in the art of making golf ball cores and balls.

TABLE IX

CORE COMPOSITION (pph)

| Example No. | 20 | 21 |
|---|---|---|
| Polybutadiene | 100 | 100 |
| Regrind | 12.5 | 12.5 |
| DBDB-60 | 0.15 | 0.15 |
| Varox 231XL ® | 0.41 | 0.41 |
| Polywate | 21.4 | 19.2 |
| Zinc Diacrylate | 20.1 | 29 |
| Zinc Oxide | 4.7 | |
| Calcium Oxide | | 4.7 |

TABLE X

COVER COMPOSITION

| Example No. | 20 | 21 |
|---|---|---|
| Low Modulus SURLYN | 30 | 30 |
| Conventional SURLYN | 70 | 70 |
| Hardness (Shore D) | 61 | 61 |

TABLE XI

| Example No. | 20 | 21 |
|---|---|---|
| Ball Initial Velocity (ft/s) | 250.1 | 249.7 |
| Core Compression | 52 | 55 |
| Ball Compression | 62 | 65 |

The following tables set forth the spin rate test data for the inventive golf balls made in Examples 20 and 21 above relative to known prior art golf balls. The Pinnacle Gold LS ball is comprised of a 1.51 inch diameter polybutadiene core covered with a Li/Na blend of conventional SURLYN and has a low spin rate. This ball is considered a good distance ball with a cover hardness of about 68 Shore D. The Titleist Tour Balata ball is comprised of a wound core covered by a balata rubber cover and has a high spin rate. This ball is considered to be a good performance ball, but is not a good distance ball. The cover is very soft and has a Shore D hardness of less than 60.

TABLE XII

Spin Rate Test Results for a Driver

| Sample | Spin Rate (rpm) |
|---|---|
| Pinnacle Gold LS | 2900 |
| Titleist Tour Balata | 4380 |
| Example 20 | 2880 |
| Example 21 | 3220 |

TABLE XIII

Spin Rate Test Results for a ½ Wedge

| Sample | Spin Rate (rpm) |
|---|---|
| Pinnacle Gold LS | 6170 |
| Titleist Tour Balata | 7250 |
| Example 20 | 6550 |
| Example 21 | 6670 |

The test results in Table XII shows that the ball having a soft cover comprised of a blend with low modulus sodium ionomer according to the present invention, Example 20, has surprisingly low spin characteristics because of the large soft core. In fact, the spin rate for the ball was lower than the Pinnacle Gold LS.

Both the Examples exhibited low driver spin rates like the Pinnacle Gold LS and ½ wedge spin rates that were better than the Pinnacle Gold LS. Thus, the overall distance of the balls according to Examples 20 and 21 are good. However, the feel of the balls according to Examples 20 and 21 are significantly better since the cover is significantly softer. Moreover, as stated above, the ball according to the present invention has a lower compression, about 80 points or lower, and thus, a good feel when hit with a driver.

It will be understood that the claims are intended to cover all changes and modifications of the preferred embodiments of the invention, herein chosen for the purpose of illustration, which do not constitute a departure from the spirit and scope of the invention.

What is claimed is:

1. A golf ball having a compression comprising:

a unitary core having a compression of about 70 or less and a diameter of about 1.55 to 1.6 inches; and a cover having a hardness of about 65 Shore D or less, wherein the cover is disposed directly on the unitary core; and wherein the cover comprises a blend of 5 to 60% of a low modulus ionomer resin having a first flexural modulus and 95 to 40% of a conventional ionomer resin having a second flexural modulus that is greater than the first flexural modulus.

2. The golf ball of claim 1, wherein the ball compression is less than about 80.

3. The golf ball of claim 2, wherein the core compression is less than about 60 and the ball compression is less than about 70.

4. The golf ball of claim 3, wherein the cover hardness is less than about 62 Shore D.

5. The golf ball of, claim 1 wherein said low modulus ionomer has a flexural modulus of between about 2,000 and 10,000 psi.

6. The golf ball of claim 5 wherein said conventional ionomer resin has a flexural modulus between about 60,000 and 70,000 psi.

7. A low compression golf ball comprising:

a core made from a mixture comprising polybutadiene, a metal salt of a material selected from the group consisting of diacrylates, dimethacrylates, monomethacrylates, and mixtures thereof, and at least one of about 1 to 10 parts per 100 parts of polybutadiene of calcium oxide or from about 1.25 to no greater than 5 parts per 100 parts of polybutadiene of zinc oxide, such that the core compression is less than about 70;

a cover having a Shore D hardness of less than about 65; and wherein the core includes a center having a first compression and at least one layer disposed about the center, wherein the core has a second compression at least 10 points lower than the first compression.

8. The golf ball of claim 7, wherein the golf ball has a compression of less than about 80.

9. The golf ball of claim 8, wherein the compression is less than about 70.

10. The golf ball of claim 7, wherein the core has a diameter of at least about 1.55 inches.

11. The golf ball of claim 10, wherein the diameter is about 1.55 to 1.6 inches.

12. The golf ball of claim 7, wherein the core has a compression of less than about 60.

13. The golf ball of claim 7, wherein the cover has a hardness of less than about 62 Shore D.

14. The golf ball of claim 7, wherein the cover consists essentially of a blend of 5 to 60% of a low modulus ionomer resin having a first flexural modulus and 95 to 40% of a conventional ionomer resin having a second flexural modulus that is greater than the first flexural modulus.

15. The golf ball of claim 14, wherein the low modulus ionomer has a flexural modulus of about 2,000 psi to 10,000 psi.

16. The golf ball of claim 14, wherein the conventional ionomer resin has a flexural modulus of about 60,000 psi to 70,000 psi.

17. The golf ball of claim 7 wherein the core comprises the zinc oxide.

18. The golf ball of claim 7, wherein calcium oxide is present in an amount from about 2 to about 5 parts per 100 parts of polybutadiene.

19. The golf ball of claim 7, wherein the polybutadiene has a cis-1,4-polybutadiene content of at least about 96%.

20. The golf ball of claim 7, wherein the metal salt is present in an amount from about 20 parts to 50 parts per 100 parts of polybutadiene.

21. The golf ball of claim 20, wherein the metal salt is zinc diacrylate.

22. The golf ball of claim 7, wherein the center is formed of the mixture.

23. The golf ball of claim 22, wherein the center is comprised of a second mixture comprising polybutadiene, zinc oxide, and a metal salt of a material selected from the group consisting of diacrylates, dimethacrylates, and monomethacrylates, and mixtures thereof.

24. A golf ball comprising:

a solid core having a layer made from a composition substantially free of zinc oxide, said composition comprising polybutadiene, a metal salt of a material selected from the group consisting of diacrylates, dimethacrylates, and monomethacrylates, and calcium oxide in an amount of about 1 to 10 parts per 100 parts of said polybutadiene;

a cover disposed about the core, said cover having a shore D hardness of less than about 65;

wherein the core further comprises a center and the layer surrounds the center; and wherein the center is solid and has a first compression ratio and the layer has a second compression ratio that is at least 10 points less than the first compression ratio.

* * * * *